United States Patent [19]

Allaire

[11] Patent Number: 4,748,442

[45] Date of Patent: May 31, 1988

[54] VISUAL DISPLAYING

[76] Inventor: Robert G. Allaire, One Castle Dr., Acton, Mass. 01720

[21] Appl. No.: 670,365

[22] Filed: Nov. 9, 1984

[51] Int. Cl.[4] ..... G09G 1/28

[52] U.S. Cl. ..... 340/750; 340/703; 340/799

[58] Field of Search ..... 340/703, 744, 747, 750, 340/798, 799, 800, 801

[56] References Cited

U.S. PATENT DOCUMENTS

| | | | |
|---|---|---|---|
| 4,225,861 | 9/1980 | Langdon, Jr. et al. | 340/703 |
| 4,484,187 | 11/1984 | Brown et al. | 340/703 |
| 4,490,797 | 12/1984 | Staggs et al. | 340/703 X |
| 4,509,043 | 4/1985 | Mossaidrc | 340/703 X |

*Primary Examiner*—Marshall M. Curtis

[57] ABSTRACT

A visual display system that provides a high speed method for reading data from a pixel memory, modifying it if desired, and then writing data into the memory. This READ/MODIFY/WRITE is accomplished by providing a RAM look-up table having a number of addressable locations. The output from one addressable location is data representative of the color/intensity of the vector being drawn, the output from other addressable locations is data representative of a desired highlight color/intensity, and the addresses of the table correspond to the data representative of the different colors/intensities. The portion of the pixel memory corresponding to the pixel to be drawn is read to an address to the RAM, and the resulting data output from the RAM is written into the pixel memory register.

15 Claims, 3 Drawing Sheets

VISUAL DISPLAYING

FIELD OF INVENTION

This invention relates to systems which display information in visual form on the screen of a Cathode Ray Tube.

BACKGROUND OF INVENTION

With the rapid advancement in development of CAD/CAM systems, most of which are vector display systems, color considerations have made it important to develop a color raster scan display system which emulates a vector display system. Yet until now, vectors displayed on raster display systems lacked some of the attributes of those displayed on vector display systems.

For example, a typical raster scan display system includes a pixel (picture element) memory which is a matrix representation of what is being displayed on the screen. Each pixel memory location corresponds with one location on the screen (e.g., the pixel memory contains one register corresponding with each of the 1,048,576 pixels of the 1024×1024 raster CRT display). The raster system takes vector information in the form of end points and transforms these end points into the appropriate registers of the pixel memory. As each vector is written into the pixel memory, the appropriate pixel color is placed into the corresponding register in the memory matrix. After a new vector is written over an old vector, the affected pixel memory registers contain the color of the new vector; not that of the old vector. Thus, in a conventional raster display system (such as IBM's Model 5080, the system sold by Spectagraphics of California, and the Vistagraphics systems of Sanders Associates), the new vector completely overlaps the old vector; one cannot determine that the old vector ever existed, and it is not possible visually to distinguish either the existence or extent of overlap. By way of contrast, on a vector display system, one can determine the existence of the overlapping vectors by observing the increase in intensity which results when the electron beam twice sweeps over any points of overlap.

Although it was plainly desirable to make visually obvious which vectors overlap and the extent of such overlap, most conventional raster display systems (including the IBM, Spectragraphics and Sanders systems referred to above, a wide range of manuals and other documentation for which is readily available to those working in the field) did not do so. The principal reason they did not was the problem of speed. To determine whether to highlight (by increase in intensity or change in color) a pixel, the conventional approach was for the central processing unit of the system to read the existing data from memory, examine the data to determine whether to write the highlight color or the vector color, and then write the appropriate data back into the memory. This procedure was far too slow to be satisfactory. It had to be accomplished on a pixel by pixel basis until all the pixels in the vector were written; and this typically took from 1.5 microseconds to 10.5 microseconds per pixel, a very slow rate. Such a slowing of response time decreased the interactiveness of the system and caused low performance and productivity.

SUMMARY OF THE INVENTION

This invention provides a system for overcoming the disadvantages of prior raster systems and providing a high speed method for reading data from the pixel memory, modifying it if desired, and then writing data into the memory. According to the preferred embodiment, this READ/MODIFY/WRITE is accomplished within 100 nanoseconds by providing a RAM look-up table having a number of addressable locations. The output from one addressable location is data representative of the color/intensity of the vector being drawn, the output from other addressable locations is data representative of a desired highlight color/intensity, and the addresses of the table correspond to the data representative of the different colors/intensities. The portion of the pixel memory corresponding to the pixel to be drawn is read to an address to the RAM, and the resulting data output from the RAM is written into the pixel memory register.

In different embodiments, this system may be used to highlight overlapping vectors, for three-dimensional depth queing, and for cursors.

DESCRIPTION

Figure 1:
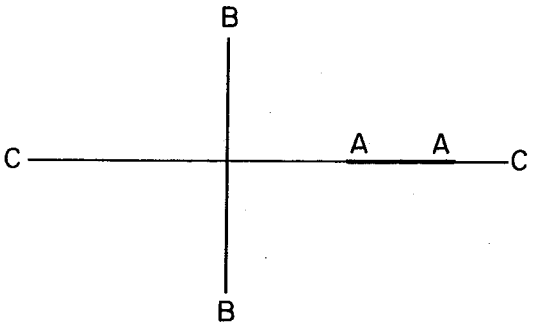
FIG. 1 illustrates a conventional vector display including overlapping vectors.

FIG. 1 illustrates a vector CRT display in which vector A-A is a short vector drawn horizontally, vector B-B is a vector drawn vertically, and vector C-C is a relatively long vector drawn horizontally over and beyond both ends of the original horizontal vector A-A and intersecting vector B-B. It will be seen (in the drawing from increased thicknesses) that both (a) the portion of vector C-C that overlies vector A-A and (b) the intersection of vectors B-B and C-C have a greater intensity (i.e., a brighter image) than do the rest of vector B-B or vector C-C. These increases in intensity are caused because the electron beam in the CRT first draws vector A-A (from left to right), then draws vector B-B (from top to bottom) and finally draws vector C-C (from left to right). When the beam crosses over a portion of the screen on which a vector has already been drawn, that portion of the screen, i.e., the portion which is being written on more than once, is highlighted. This highlighting effect is very important in vector display technology.

Figure 2:
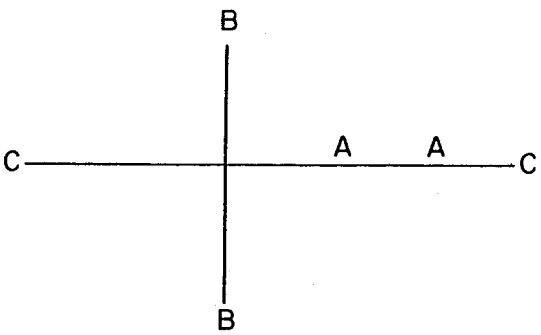
FIG. 2 is a view of a conventional raster scan CRT display containing overlapping vectors.
Figure 3:
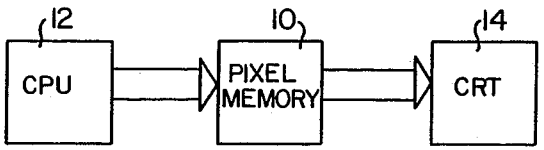
FIG. 3 is a block diagram of a conventional raster scan system.

FIG. 2 illustrates the image resulting when the same vectors are drawn and displayed on the CRT display of a conventional raster scan system. No highlighting occurs, either where vector C-C intersects vector B-B or where vector C-C overlaps vector A-A. The intersection of vectors B-B and C-C is the color of the last drawn vector C-C, as is the entire length of vector C-C. This is because, unlike in a vector display system in which vectors are drawn directly onto the screen, the vectors in a raster system are not. Rather, and as shown schematically in FIG. 3, the information relating to the new vector to be drawn is written from central processor 12 into pixel memory 10, writing over any pre-existing data in the affected pixel memory registers, i.e., writing over any data corresponding to a previously drawn vector. Then the newly-written data, i.e., the data corresponding to the new vector, is displayed on the screen, and there is nothing in this data to indicate that any previous vector ever existed.

Figure 4:
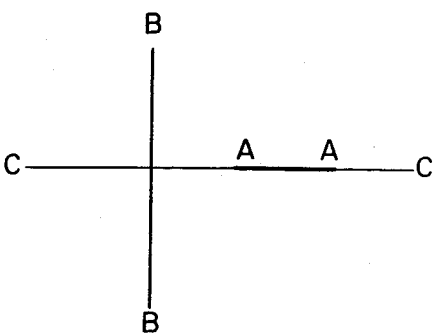
FIG. 4 is a view of a raster scan CRT display produced according to the present invention.

FIG. 4 is a front view of a color CRT with 1024×1024 pixels on which the same vectors as in FIGS. 1 and 2 have been drawn, this time with a raster system embodying the present invention. Here, the intersection of vectors B-B and C-C is highlighted (e.g., is drawn in a highlighting color or intensity different than the color of any of the vectors per se), as is the portion of vector C-C that overlaps vector A-A, thereby emulating, and indeed improving upon, the vector display of FIG. 1. As in FIG. 1, the drawing indicates the overlapping portions by increased thickness.

Figure 5:
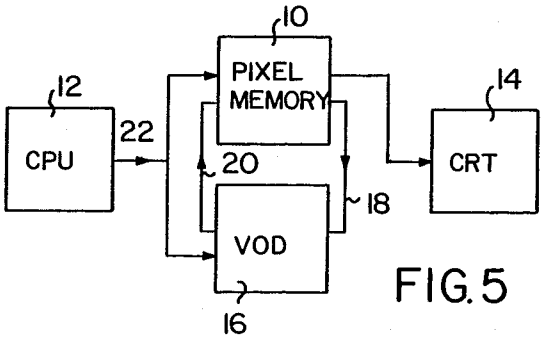
FIG. 5 is a block diagram of the system of the present invention.

The system for accomplishing this highlighting is shown schmetically in FIG. 5. As shown, it is essentially the same as the conventional system shown in FIG. 3, except that it includes also a Visual Overlay Display ("VOD") generally designated 16 and including a RAM look-up table, and both the input data line 18 and output data line 20 of which are connected to the respective data output and data input lines of the pixel memory 10.

In addition to data lines 18 and 20 connected to VOD 16, the pixel memory has data lines connected conventionally (as in the FIG. 3 system) to central processor 12 and CRT 14.

The number of addressable locations of VOD 16 is sixteen, equal to the number of different colors that are to be displayed on screen 14. In the illustrated embodiment, the sixteen different colors may be displayed include a background color where no vector has been drawn, a highlighting color where there are overlapping vectors, and fourteen other colors representative of non-overlapping portions of different vectors. Each color is represented by a different four-bit nibble; each register of pixel memory 10 corresponding to one of the pixels of CRT 14 will contain one of the nibbles—the nibble corresponding to the background color if no vector has previously been drawn at the pixel corresponding to the particular register, the nibble corresponding to the most-recently drawn vector if a vector has been drawn at the pixel, or the nibble corresponding to the highlight color if intersecting vectors have previously been drawn at the pixel. Each of the sixteen addresses of the VOD 16 is identified by one of the nibbles also, so that when VOD 16 reads the data from one of the registers of the pixel memory, it will be read to the corresponding address of the VOD, i.e., when data representative of the background color, e.g., 1111, is read from the pixel memory 10 to VOD 16 it will be read to address 1111 of VOD 16.

Before each vector is drawn, the RAM look-up table of VOD 16 is set so that the output from each addressable location, other than the one whose address is identified by the nibble corresponding to the background color, is the data nibble corresponding to the highlighting color; and the output from the one whose address does correspond to the background color is the date nibble corresponding to the color of the vector then to be drawn. i.e., if a red vector is to be drawn, the output from the addressable location whose address is identified by the nibble corresponding to the background color is the data corresponding to the color red, while the output from all the other addresses is the data nibble corresponding to the highlight color.

Thus, when the data read to the VOD corresponds to a background color, i.e., the data indicates that no vector previously has been drawn at the pixel corresponding to the register of the pixel memory 10 being read, the data output of the VOD will be the data corresponding to the color of the vector then being written, and that data is written back into the just-read pixel memory register. Similarly, when the data read to the VOD corresponds to any other color, i.e., the data indicates that a vector previously has been drawn at the pixel corresponding to the register of the pixel memory being read, the data written back into the just-read register will represent the highlight color.

Reference is again made to FIG. 3. For convenience in the examplary discussion that follows, the vector colors, the data nibbles representing the vector colors, and the VOD addresses will be identified as follows:

| vector color | data nibble | VOD address |
|---|---|---|
| background | b | B |
| highlight | h | H |
| red | r | R |
| green | g | G |
| yellow | y | Y |

Before vector A-A is drawn, the pixel memory is been cleared so that the data nibble in each of the registers of pixel memory 16 corresponding to one of the pixels of CRT 14 is data nibble b, and the screen of CRT 14 is blank (i.e., is entirely the background color). Central processor 12 initially loads VOD 16 so that one address of the RAM look-up table corresponds to each of the different color vectors possibly to be drawn (e.g., one address is R [corresponding to data nibble r representative of red], one is G [corresponding to data nibble g representative of green] and a third is Y [corresponding to data nibble y representative of yellow]), one address is B (corresponding to data nibble b of the background color) and one is H (corresponding to the data nibble h of the highlighting color). The central processor 12 also loads the look-up table of the RAM of VOD 16 so that the data output from all of the addresses will be the data nibble h corresponding to the highlighting color.

When vector A-A (which will be assumed to be a red vector) is to be drawn, the central processor makes one change in the look-up table of the RAM of VOD 16; it changes the output from address b, i.e., from the address corresponding to the background data, to data nibble r, i.e., to the data nibble representing red, the intended color of vector A-A.

Each register in pixel memory 10 that corresponds to a pixel of to-be-drawn vector A-A is then read to VOD 16. Since A is the first vector being drawn, the data at each register is b, and each register is read to address B. As each pixel memory register is read, VOD 16 outputs the data from the address being read and that output data is written into the just-read pixel memory register. In the case of this first-drawn vector A-A, data nibble r, the output from VOD address B, is written into each pixel memory register corresponding to a pixel of vector A-A before the vector is drawn onto the screen of CRT 14.

The vector is drawn on the CRT from the pixel memory 10 in the conventional manner. Since, after being read, modified and written by VOD, the data in each register of the pixel memory 10 corresponding to a pixel of vector A-A is data nibble r, the entire vector A-A will be red. In a conventional system such as that of FIG. 3, by way of comparison, the central processor 12 would write a data nibble r into each pixel memory register that corresponds to a pixel of vector A-A before that vector was drawn, and the entire vector A-A in the screen shown in FIG. 2 would be red also.

The next vector to be drawn is vector B-B, assumed to be a green vector; and the central processor 12 changes look-up table of the RAM of VOD 16 so that the output from address b, i.e., from the address corresponding to the background data, to the data nibble corresponding to the color of the intended vector, this time to data nibble g. As before, each memory register of pixel memory 10 corresponding to a pixel of vector B-B is then read to VOD 16. Since vector B-B does not intesect any previously drawn vector, each of these pixel memory registers is read to address b, and the data output from address b, i.e., data nibble g, is written into the just-read pixel memory registers. When the vector is then drawn from the pixel memory, the entire vector B-B will be green.

The third vector drawn is vector C-C, assumed to be a yellow vector. Again, the central processor first changes the output of address b of VOD 16 to the data nibble corresponding to the color of the to-be-drawn vector, i.e., to y, and each memory register of pixel memory 10 corresponding to a pixel of vector C-C is then read to the VOD. The data from most of the registers read will be b, i.e., will correspond to the background color since no vector has previously been drawn at most of the pixels of to-be-drawn vector C-C; and the data from VOD 16 written into the pixel memory registers will be data nibble y, the data representative of the yellow color to to-be-drawn vector C-C. However, this is not true of all the pixel elements in vector C-C; vector C-C will intersect previously drawn vectors A-A and B-B. Before the process of drawing vector C-C is begun, the data at the pixel memory register corresponding to the pixel that will be at the intersection of vectors B-B and C-C is data nibble g, corresponding to the color of previously-drawn green vector B-B; and the data at the pixel memory registers corresponding to the pixels that will be at the overlying portions of vectors A-A and C-C is data nibble r, corresponding to the color of previously drawn red vector A-A. Thus, when the pixel memory register corresponding to the pixel at which vectors B-B and C-C intersect is read, it will be read at address G of VOD 16, and data nibble h will be output from VOD and rewritten into the pixel memory register. Similarly, when each pixel memory register corresponding to a pixel at which vectors A-A and C-C overlie is read, it will be read at address R of VOD 16 and data nibble h will be output from VOD and rewritten into the pixel memory register.

Thus, when all the pixel memory registers corresponding to pixels of to-be-drawn vector C-C have been read and rewritten, the registers corresponding to the intersection of vector B-B and C-C and to the portion of vector C-C overlying vector A-A will contain data nibble h, while each of the other registers corresponding to a pixel of vector C-C will contain data nibble y. When the vector C-C is then drawn onto the screen of the CRT 14 from the pixel memory 10, the intersection of vectors B-B and C-C and portion of vector C-C overlying vector A-A will be drawn in the highlighting color, and the remaining portion of vector C-C will be yellow.

Figures 1, 6:
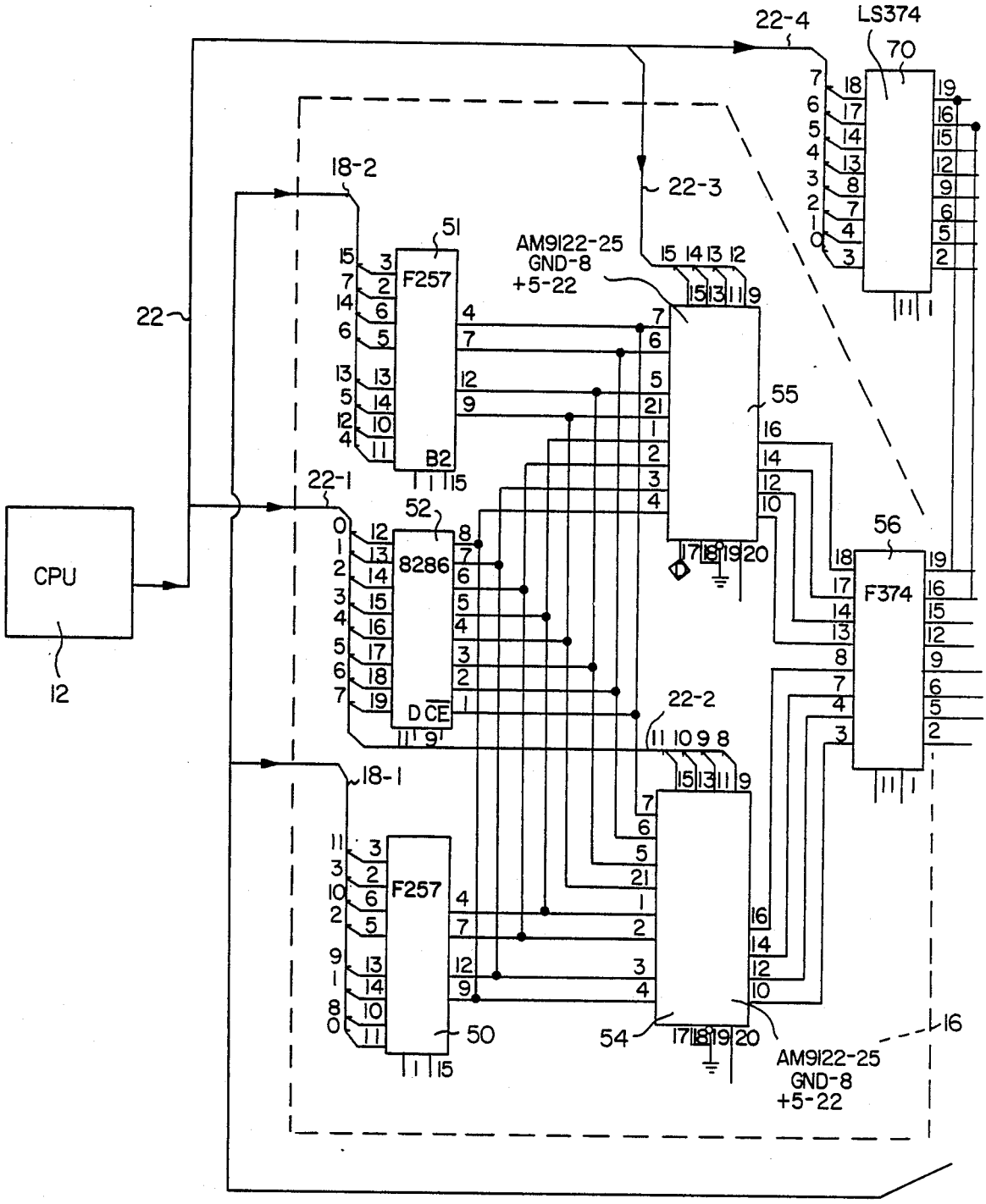
FIG. 6 is a more detailed schematic of the system of FIG. 5.
Figures 2, 6:
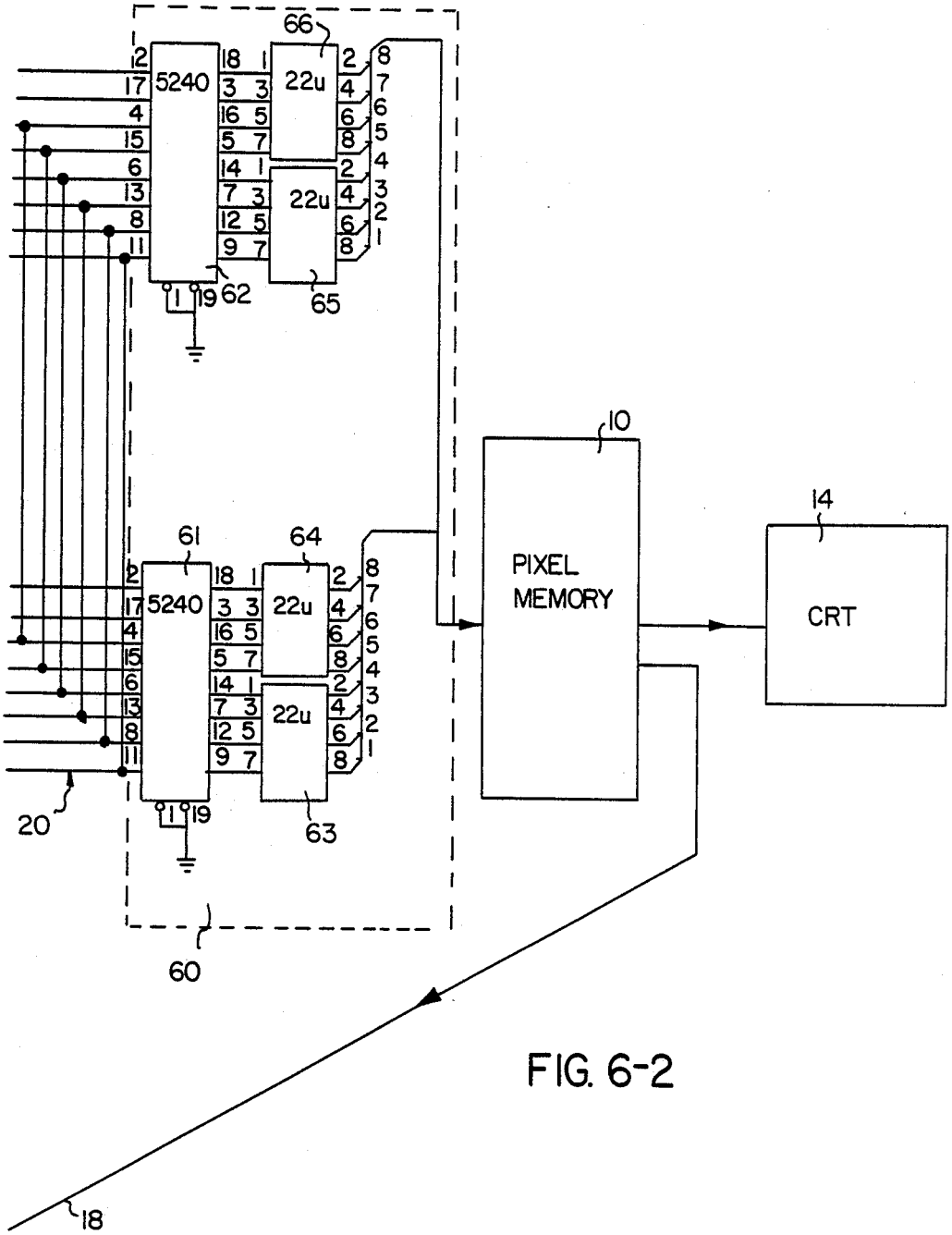

In the preferred embodiment, pixel memory 10 comprises four arrays of sixteen 64k bit RAMS (each manufactured by Mosstek). As shown in FIG. 6, VOD 16 includes two multiplexer chips 50, 51 (in the preferred embodiment, each a Fairchild part no. F267), a processor interface chip 52 (in the preferred embodiment, an Intel 8286), a pair of RAM look-up tables 54, 55 (in the preferred embodiment, each an AMD9122-25) and a latch 56 (in the preferred embodiment, a Fairchild F374). The data input lines 18-1 and 18-2 of multiplexer chips 50, 51 are connected to data line 18 from the output of pixel memory 10; and the data input line 22-1 of processor interface chip 52 and the address input lines 22-2 and 22-3 of look-up tables 54, 55 are connected to the graphic data output line 22 of CPU 12. The data output lines of multiplexer chips 50, 51 and of processor interface chip 52 are connected to the data inputs of RAM look-up tables 54, 55, and the outputs from the look-tables are connected to the inputs to latch 56.

The data output lines 20 from latch 56 constitute the output from VOD 16 and are connected to a pixel memory driver, generally designated 60 and comprising a pair of driver chips 61, 62 (in the preferred embodiment, Texas Instruments S240 chips) and four 22 ohm resistors 63, 64, 65, 66, which is in turn connected to the input of pixel memory 10. As shown output lines 20 are connected to the inputs of driver chips 61, 62, and the outputs from the driver chips are connected to the pixel memory through the resistors 63 through 66.

As previously indicated, the data and addresses used in the system of the present preferred embodiment are four-bit nibbles. The circuitry shown in FIG. 5 is designed for use in this system, but has the capability also of processing eight-bit address and data bytes. When only four-bit nibbles are employed, multiplexer 51 and RAM look-up table 55 are not used; the input from pixel memory 10 is read through multiplexer 50 to look-up table 54 only.

Referring again to FIG. 5, it will again be noted that the system of the present invention is arranged so that pixel memory 10 has input data lines 22 connected to central processor 12, for drawing vectors on the screen of CRT 14 in the conventional manner, i.e., without highlighting. The drive system used for such conventional, non-highlighting vector generation is also shown in more detail in FIG. 6. As shown, a pixel data register 70 (in the preferred embodiment, a Texas Instruments LS 374) has its data inputs connected to data input line 22-4 connected to data line 22 from the central processor, and its outputs connected to pixel memory driver 60, in parallel with the outputs 20 from VOD 16. When it is desired to generate vectors in the conventional manner, the data representative of the various pixel elements is written into the pixel memory 10 from register 70 and through pixel memory driver 60. When it is desired to generate vectors in accord with the present invention so that overlapping vectors are highlighted, the data representative of the pixel elements is written into pixel memory 10 through the pixel memory driver 60 but from VOD 16. In both cases, the vectors are drawn on the screen of CRT 14 using the data in the pixel memory.

OTHER EMBODIMENTS

In the above-described operation of the preferred embodiment, only a single highlighting color was employed regardless of the number of vectors that overlapped at any pixel. If desired, a number of different highlighting colors could be used, thereby making it possible visually to indicate that three, four, or even more vectors overlapped at a point. This can be accomplished simply by changing the data at the addresses of the RAM look-up table of VOD 16. For example, if it was desired to show both (a) when two vectors overlapped at a particular pixel and (b) when three or more vectors overlapped at a particular pixel, the vector colors, data nibbles representing the vector colors, and VOD addresses could be chosen as follows:

| vector color | data nibble | VOD address |
|---|---|---|
| background | b | B |
| highlight #1 | h | H |
| highlight #2 | h' | H' |
| red | r | R |
| green | g | G |
| yellow | y | Y |

highlight #1 being the color chosen to show a two-vector overlap and highlight #2 being the color chosen to shown a more-than-two-vector overlap; and the VOD could be loaded so that one address of the RAM corresponds to each of the colors (including both the background, two highlight, and vector colors), the data output from both address H (corresponding to the data nibble of highlight color #1) and H' (corresponding to the data nibble of hightlight color #2) is h' (the data nibble of highlight color #2), and, as before, the data output from every other address is h (the data nibble of highlight color #1). If, as previously discussed, the central processor changes the output from address b (i.e. the address corresponding to the background data) to the data corresponding to the color of the intended color of a to-be-drawn vector, it will be seen that any point at which the to-be-drawn vector intersects a single previous vector will be drawn on the screen of the CRT in highlight color #1, while any point at which the to-be-drawn vector intersects an already highlighted pixel (i.e., at point at which there will be more than two vectors overlapping or intersecting) will be highlight color #2. Systems employing the present invention also may be used for other types of READ/-MODIFY/WRITE instructions, such as depth queuing for three-dimensional hidden-surface removal or for cursors.

Pixel memories may include three-dimensional information, i.e., the registers corresponding to each pixel may hold an 8-bit byte in which the first 4 bits are representative of depth, the distance from the viewer's eye of the information displayed by the pixel, and the last 4 bits are representative of the intensity or color. The system of the present invention may be used to read determine whether any information currently held in the pixel memory (or displayed on the CRT screen) is closer or farther away than the depth of information to be written. If so, then the new information is written over the older information; if it is farther away, then the older information remains intact. Thus, if a closer figure is drawn over a more distant one, latter simply disappears.

To accomplish this, the RAM look-up table of the VOD is set so that its addresses correspond to data representative of the depth information, and so that the output from the various addresses corresponding to depths closer to the viewer than the depth of the to-be written vector will be the depth and color/intensity of the to-be written vector, while that of addresses corresponding to depths farther away from the viewer will be the same data as that already in the memory. The table may be set to provide either result, as desired, in the case where the second vector is to be written at the same depth as one already existing.

Similarly, the system may be used for cursors. The RAM look-up of the VOD is first set so that the data output of each of its addresses is the exclusive OR of the data nibble corresponding to the address. Then, as the pixel memory registers corresponding to the pixels of the cursor are read, the exclusive OR's are rewritten back into the respective pixel memory registers and displayed on the CRT screen. When the cursor moves, the procedure is repeated at the old cursor location, again causing an exclusive ORing of the data at the affected pixel memory registers and restoring the original data at those registers; and the new cursor position is then read, exclusively ORed and rewritten.

Other embodiments will be within the scope of the following claims.

What is claimed is:

1. A raster display system comprising a display having a plurality of picture elements (pixels), a pixel memory for storing data representative of the display, a respective portion of said memory being associated with each of said pixels and means for drawing at each of said pixels a pixel display representative of the data in the portion of said memory associated with the respective pixel, said system being characterized in that:

there is provided a look-up table having a plurality of addressable locations and a data output from each of said locations, the look-up table having input address lines and output data lines connected respectively to outputs from and inputs to said pixel memory;

said system is arranged to read data stored at a selected location of said look-up table and to write the data output from the addressed location into said selected portion of said pixel memory whereby said means draws at the pixel associated with said selected portion of said memory a pixel display representative of said data output from said addressed location;

the addresses of the addressable locations of said look-up table and the data generated by said look-up table each correspond to one of various data each of which is representative of a color of said display;

one of said data is a selected highlight color, a second of said data is a background color, and a third of said data is a color other than said highlight color and said background color;

one of said addresses is said second data and a second of said addresses is data other than said second data, and said look-up table is arranged to generate modified data comprising said third data when said second data addresses said one address and to generate modified data comprising said first data when data other than said second data is read to said second address.

2. The raster display system of claim further characterized by a processor interface having its input connected to said means and wherein said look-up table has its input address lines connected to said processor interface and said pixel memory.

3. The system of claim 1 including driving chips for writing data into said pixel memory and further characterized in that the inputs to said driving chips are selectively connectable to said control in a first mode through said look-up table and in a second mode bypassing said look-up table, said control being operable to draw said pixel displays on said display in either of said modes.

4. The method of drawing a multi-color display comprising a plurality of picture elements (pixels), said method including providing a pixel memory for strong data representative of the display, a respective portion of said memory being associated with each of said pixels, drawing at each of said pixels a pixel display representative of the data in the portion of said memory associated with the respective pixel, said method being characterized by:

providing a look-up table having a plurality of addressable locations and arranged to provide a selected data output from each of said locations when data addresses said each location, the look-up table having input address lines and output data lines connected respectively to outputs from and inputs to said pixel memory;

selecting a first data representative of a selected highlight color/intensity, a second data representative of a background color/intensity, and a third data representative of a color/intensity other than said highlight color/intensity and said background color/intensity;

loading said table so that the address of one of the addressable locations thereof is said second data and that of a second of said addressable locations is other than said second data, and so that said output from said one addressable location is said third data and said output from said second addressable location is data other than said second data;

causing data stored at a selected portion of said memory to address a selected one of said addressable locations of said look-up table and writing the resulting data output into said selected portion of said pixel memory; and, drawing at the pixel associated with said selected portion of said memory a pixel display representative of said data output from said addressable location.

5. The method of claim 4 further characterized in that the data output from said selected addressable location is a first modified data if said data stored at said portion of said memory is a first predetermined data and is another modified data if said data stored at said portion of said memory is other than said first predetermined data.

6. The system of claim 4 including the step of thereafter selecting another color/intensity as the color/intensity of a pixel display to be drawn at a pixel of said display, changing the output from the addressable location of said table having the address which corresponds to the first selected color/intensity so that the output thereof is said first data, and changing the output from the addressable location of said table having the address which corresponds to the second selected color/intensity so that the output thereof is data representative of said second selected color/intensity.

7. A raster display system including: a pixel memory; and, a data look-up table having input address lines and output data lines connected respectively, to outputs from and inputs to said pixel memory, the addresses of the addressable locations of and data generated by said data look-up table each corresponding to various data each of which is representative of a color to be displayed on said display system, one of said data being representative of a selected highlight color, a second of said data being representative of a background color, and a third of said data being representative of a color other than said highlight color and said background color, one of said addresses being said second data and a second of said addresses being other than said second data, and said look-up table being arranged to generate modified data comprising said third data when second data addresses said one address and being arranged to generate modified data comprising said first data when data other than said second data is read to said second address.

8. In the method of drawing a multi-color display, that improvement comprising the steps of:

providing a pixel memory and a data look-up table, the look-up table having input address lines and output data lines connected respectively to outputs from and inputs to said pixel memory;

selecting a first data representative of a selected highlight color/intensity, a second data representative of a background color/intensity, and a third said data representative of a color/intensity other than said highlight color/intensity and said background color/intensity; and loading said table so that the address of one of the addressable locations thereof is said second data and that of a second of said addressable locations is other than said second data, and so that said output from said one addressable location is said third data and said output from said second addressable location is data other than said second data.

9. The system of claim 1 further characterized in that said second address is said third data and said look-up table is arranged to generate modified data comprising said first data when said third data addresses said second address.

10. The system of claim 9 further characterized in that a third of said addresses is said first data and said look-up table is arranged to generate said first data when said first data addresses said second address.

11. The method of claim 4 wherein the address of said second addressable location is said third data and said look-up table is loaded so that the output from said second addressable location is said first data.

12. The method of claim 11 wherein said look-up table is loaded so that the address of a third addressable location thereof is said first data and so that the output from said second addressable location thereof is said first data.

13. The method of claim 4 wherein each of said third data and a fourth data is representative of a respective color/intensity other than said highlight color/intensity and said background color/intensity, and including the steps of (a) selecting the color/intensity of which said third data is representative as the color/intensity of a pixel display to be drawn at a pixel of said display, and (b) loading said table so that the addresses of each of a third and a fourth addressable locations thereof is said third data and the output from each of said third and fourth addressable locations is said first data.

14. The method of claim 13 wherein said table is loaded such that the address of and the output from said second addressable location are said first data.

15. The method of claim 14 including the steps of drawing said pixel display in the color/intensity of which said third data is representative, and thereafter (a) selecting the color/intensity of which said fourth data is representative as the color/intensity of a pixel display to be drawn at a pixel of said display, and (b) loading said table so that the addresses of each of said third and fourth addressable locations thereof is said fourth data.

* * * * *

UNITED STATES PATENT AND TRADEMARK OFFICE

CERTIFICATE OF CORRECTION

PATENT NO. : 4,748,442

DATED : May 31, 1988

INVENTOR(S) : Robert G. Allaire

It is certified that error appears in the above-identified patent and that said Letters Patent are hereby corrected as shown below:

Col. 9, line 1, "system of claim further" should be

-- system of claim 1 further --

Signed and Sealed this

Eleventh Day of October, 1988

*Attest:*

DONALD J. QUIGG

*Attesting Officer*

*Commissioner of Patents and Trademarks*